United States Patent [19]

Lotta

[11] 4,087,127

[45] May 2, 1978

[54] SEATING UNIT FOR A BATH TUB, SHOWER STALL OR THE LIKE

[76] Inventor: Russell P. Lotta, 1632 Regina La., Rockford, Ill. 61102

[21] Appl. No.: 790,401

[22] Filed: Apr. 25, 1977

[51] Int. Cl.[2] ..... A47C 1/126

[52] U.S. Cl. ..... 297/14; 108/81; 248/240.1

[58] Field of Search ..... 297/14, 15; 108/48, 108/38, 81; 248/240.1, 240.2; 4/185 S, 185 AB

[56] References Cited

U.S. PATENT DOCUMENTS

| | | | |
|---|---|---|---|
| 1,610,956 | 12/1926 | Lannom | 248/240.1 X |
| 2,154,125 | 4/1939 | Dillon | 108/81 X |
| 2,284,003 | 5/1942 | Luppert | 108/81 |
| 2,352,837 | 7/1944 | Hillenbrand | 108/81 X |
| 2,633,179 | 3/1953 | Smith | 248/240.1 |
| 3,873,151 | 3/1975 | Morris et al. | 297/14 |
| 4,009,903 | 3/1977 | Manspeaker | 297/14 |

*Primary Examiner*—Francis K. Zugel
*Attorney, Agent, or Firm*—Leydig, Voit, Osann, Mayer & Holt, Ltd.

[57] ABSTRACT

A seating unit is adapted to support a person in a sitting position in a bath tub or a shower stall and may be folded and stored compactly in an opening in a wall when not in use.

1 Claim, 6 Drawing Figures

SEATING UNIT FOR A BATH TUB, SHOWER STALL OR THE LIKE

BACKGROUND OF THE INVENTION

This invention relates to a seating unit for supporting a person in a sitting position in a bath tub, a shower stall or the like.

SUMMARY OF THE INVENTION

The general aim of the present invention is to provide a new and improved seating unit which normally may be stored in a compactly folded position in a wall adjacent the tub or shower stall and which may be easily unfolded and placed in a use position in the tub or stall.

A more detailed object is to provide a seating unit having a seat and also having a leg which rigidly supports the seat when the latter is in its use position, both the seat and the leg being adapted to be easily and compactly folded into the wall when it is desired to remove the unit from the tub or stall.

The invention also resides in the unique provision of foldable braces between the seat and the leg in order to insure against the seating unit collapsing when the unit is in use.

These and other objects and advantages of the invention will become more apparent from the following detailed description when taken in conjunction with the accompanying drawings.

DETAILED DESCRIPTION OF THE PREFERRED EMBODIMENT

Figure 1:
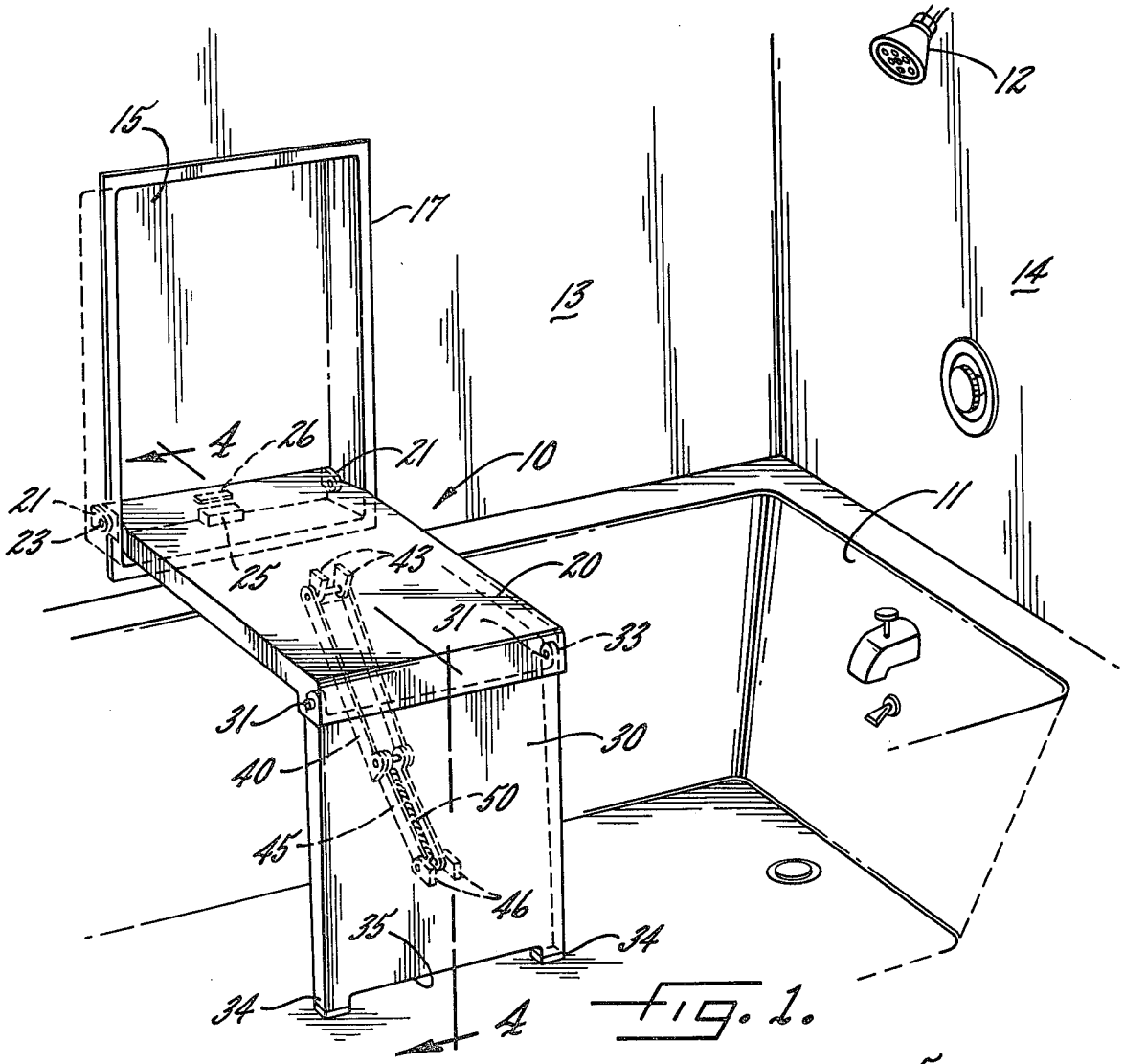
FIG. 1 is a perspective view of a new and improved seating unit incorporating the unique features of the present invention and shows the unit ready for use in a typical bath tub.

The present invention contemplates the provision of a new and improved foldable seating unit 10 which may be used in a bath tub or a shower stall to support a person in an elevated sitting position while the person is bathing. The seating unit finds particularly advantageous use in nursing homes, hospitals, and homes for the elderly since the unit enables an aged or infirmed person to bathe without need of either standing in the shower or sitting on the bottom of the tub and also facilitates entry of the person into the tub. When the unit is not in use, it may be folded to an out of the way storage position in the wall which is located adjacent the tub or shower stall.

In the present instance, the seating unit 10 is shown in conjunction with a bath tub 11 which is located next to two right angular walls 13 and 14, there being a shower head 12 projecting from the wall 14. The unit comprises a generally rectangular box 15 having an open side and adapted to fit in a correspondingly shaped opening 16 (FIGS. 4 and 5) formed in the wall 13 just above the tub 11. The box is made of rigid plastic and is located in the opening 16 with its open side facing outwardly. An outwardly projecting peripheral flange 17 is molded integrally with the outer side of the box and engages the wall 13 around the margins of the opening 16, the outer side of the box thus being substantially flush with the wall. The box preferably is cemented in place within the opening 16 although other securing means could be used.

The seating unit 10 further includes a seat 20 which is adapted to swing downwardly from a vertical storage position disposed within the box 15 to a horizontal use position projecting outwardly from the wall 13 and spaced upwardly from the bottom of the tub 11. The seat 20 also is molded from rigid plastic and has approximately the same height and width as the interior of the box.

To support the seat 20 for swinging between its storage and use positions, ears 21 (FIG. 4) are molded integrally with the inside of the box 15 adjacent the lower corners thereof and are pivotally connected at 23 with ears 24 molded integrally with the inner end portion of the seat. A raised boss 25 projects upwardly from the lower side of the box near the center thereof and lies in the path of a resiliently yieldable lip 26 which projects inwardly from the inner end of the seat 20. When the seat is swung upwardly from its use position (FIG. 4) to its storage position (FIG. 5), the lip 26 flexes or snaps past the boss 25 and then engages the outer side of the boss to hold the seat releasably in its storage position. When the seat is initially swung downwardly, the lip flexes reversely past the boss and releases the seat for continued downward swinging.

Figure 3:
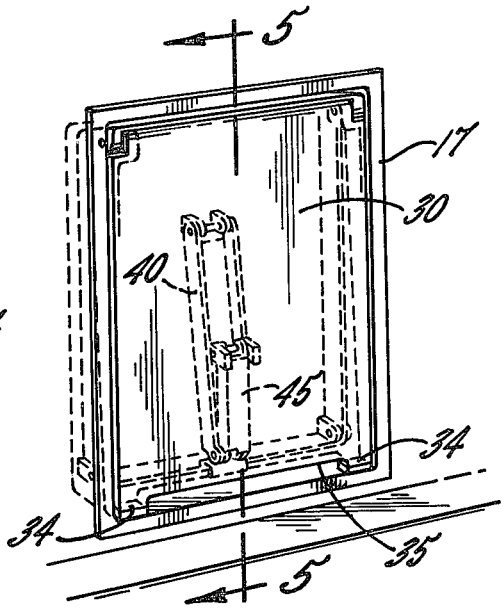
FIG. 3 is a perspective view similar to FIG. 2 but shows the seating unit in a fully folded position.
Figure 5:
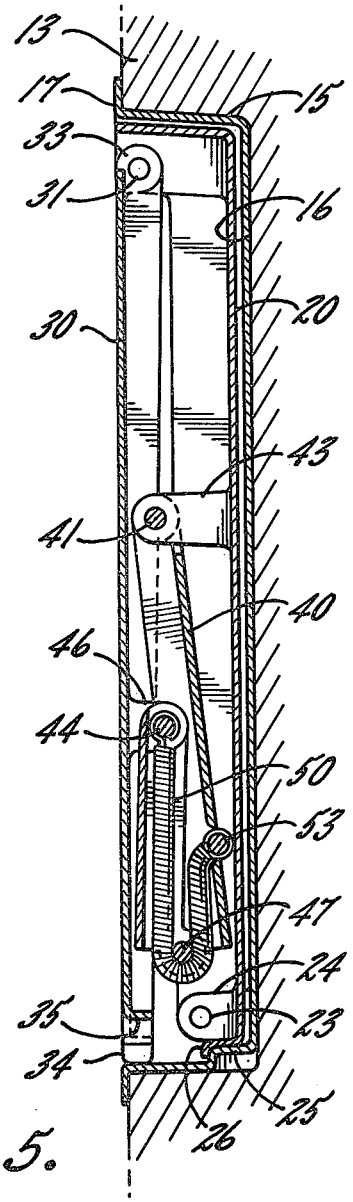
FIG. 5 is an enlarged fragmentary cross-section taken substantially along the line 5—5 of FIG. 3.

In keeping with the invention, a leg 30 is connected pivotally to the outer end of the seat 20 and rigidly supports the seat when the latter is in its use position. When the unit 10 is folded to its storage position, the leg 30 moves into the box 15 alongside the outer side of the seat 20 and closes the outer side of the box as shown in FIGS. 3 and 5.

The leg 30 also is molded of rigid plastic and also has approximately the same height and width as the interior of the box 15. Horizontal pins 31 (FIG. 4) are molded integrally with the outer end of the seat and project through ears 33 on the upper end of the leg to connect the leg pivotally to the seat.

As shown in FIG. 1, two horizontally spaced feet 34 are formed on the lower end of the leg 30 and may be provided with non-slip pads which engage the bottom of the tub 11 when the leg is in its use position. When the leg is swung upwardly to its storage position, the pads engage the lower side of the box 15 and frictionally hold the leg in the box (see FIGS. 3 and 5).

As a result of the feet 34, a recess or hand hole 35 (FIG. 1) is defined at the lower end of the leg 30. A person may place his hand in the hand hole when lifting the unit 10 from its use position to its storage position or when unfolding the unit from the box 15 and moving the unit to its use position.

Means are provided for bracing the seat 20 and the leg 30 when the unit 10 is in its use position in order to prevent the leg from pivoting and allowing the seat to collapse. Herein, these means comprise a first brace 40 (FIG. 4) whose upper end is pivotally connected by a pivot pin 41 to a pair of ears 43 on the underside of the seat 20. A second pivot pin 44 pivotally connects the lower end of a second brace 45 to ears 46 on the inner side of the leg 30 while a third pivot pin 47 pivotally interconnects the upper end of the brace 40 with the lower end of the brace 45. When the unit 10 is in its use position, the brace 40 extends downwardly and outwardly from the lower side of the seat 20 while the brace 45 extends upwardly and inwardly from the inner side of the leg 30. With the braces so positioned, the pivot pin 47 is located outwardly of and above a straight line which extends between the pivot pins 41 and 44.

Figure 4:
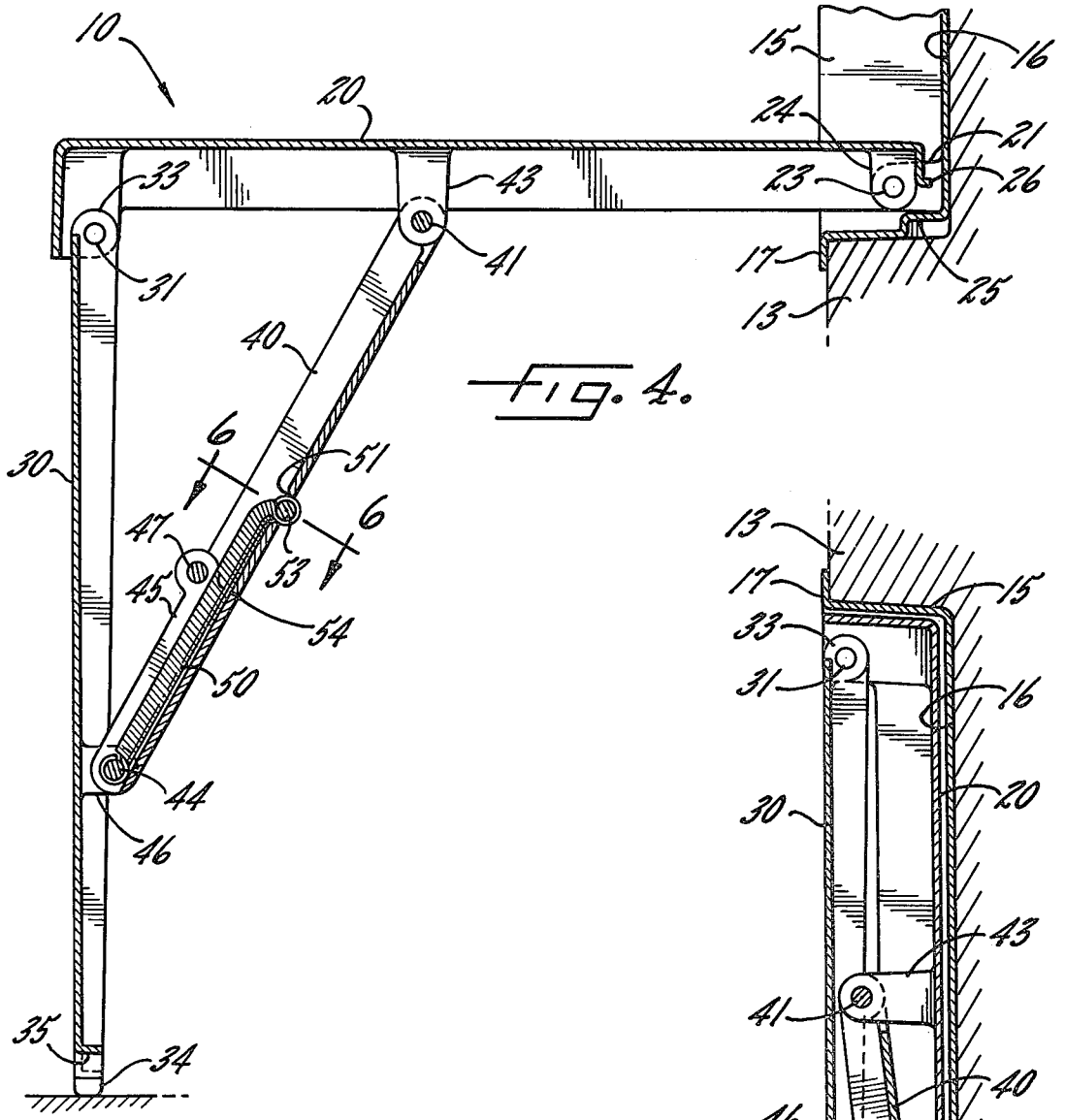
FIG. 4 is an enlarged fragmentary cross-section taken substantially along the line 4—4 of FIG. 1.
Figure 6:
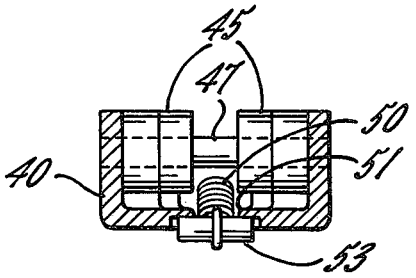
FIG. 6 is an enlarged cross-section taken substantially along the line 6—6 of FIG. 4.

As shown in FIGS. 4 to 6, a contractile spring 50 is connected at its lower end to the pivot pin 44 while the upper end of the spring extends through an opening 51 formed in the lower end portion of the brace 40. A pin 53 (FIG. 6) is inserted through the upper end of the spring and bears against the lower side of the brace 40 to anchor the spring to the brace. When the unit 10 is positioned as shown in FIG. 4, the spring 50 urges the leg 30 inwardly relative to the outer end of the seat 20 and tends to pull the lower end of the brace 40 into engagement with the upper end of the brace 45.

By virtue of the braces 40 and 45 and the spring 50, the leg 30 is prevented from swinging outwardly relative to the seat 20 when the unit 10 is in its use position shown in FIGS. 1 and 4. Also, the spring 50 urges the upper end of the brace 45 into abutting engagement with the lower end of the brace 40 as indicated at 54 in FIG. 4 and thereby prevents the brace 45 from pivoting downwardly relative to the brace 40 and prevents the leg 30 from swinging inwardly relative to the seat 20. Accordingly, the braces coact with the leg to support the seat in a rigid horizontal position.

Figure 2:
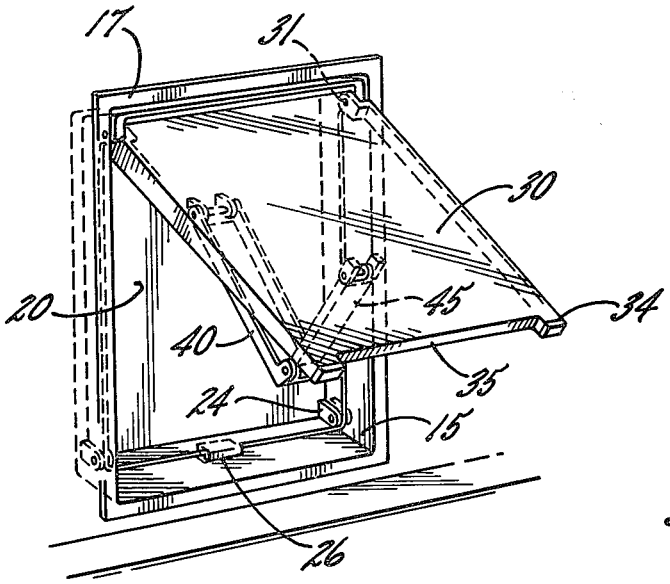
FIG. 2 is a fragmentary perspective view similar to FIG. 1 but shows the seating unit partially folded toward its storage position.

To fold the unit 10 from its use position to its storage position, the leg 30 is raised upwardly by lifting the lower end of the leg adjacent the hand hole 35. As the leg is raised, the seat 20 begins swinging upwardly about the pivots 23 and, at the same time, the braces 40 and 45 pivot toward a collapsed position as shown in FIG. 2. With continued lifting of the leg 30, the seat 20 swings upwardly into the box 15 and, as an incident thereto, the brace 45 moves into nesting relationship with the brace 40 (See FIGS. 3 and 5). Finally, the leg 30 is swung downwardly about the pivots 31 and is placed in the outer side of the box 15. When the leg is in the box, the spring 50 urges the leg inwardly about the pivots 31 and helps hold the leg in its folded storage position.

To unfold the unit 10, the lower end of the leg 30 is grabbed adjacent the hand hole 35 and the leg is swung outwardly about the pivots 31. With continued pulling of the leg 30, the seat 20 is swung downwardly about the pivots 23 and is withdrawn from the box 15. As the leg and the seat are unfolded, the braces 40 and 45 toggle overcenter by virtue of the location of the pivots 41 and 44 relative to the pivot 47 and thus the braces securely hold the seat in its horizontal position and the leg in its vertical position.

From the foregoing, it will be apparent that the present invention brings to the art a new and improved foldable seating unit 10 which enables senior citizens and partial invalids to bathe in a tub or a shower without need of standing or sitting on the bottom of the tub. The seating unit is particularly helpful to nursing personnel since the unit enables a patient to be placed in a tub without need of lowering the person completely to the bottom of the tub. The unit may be compactly folded into the wall 13 and, when so folded, the leg 30 closes the outer side of the box 15 and presents an attractive appearance.

I claim:

1. A foldable seating unit for use in a bath tub, a shower stall or the like, said unit comprising a generally rectangular box having an open side, said box being adapted to fit in an opening in a wall with the open side of the box facing outwardly and disposed substantially flush with the wall, a seat having approximately the same height and width as said box and pivotally connected to the lower end portion of said box to swing downwardly from a vertical storage position to a horizontal use position, said seat being disposed within said box when in said storage position and projecting outwardly from said box when in said use position, a leg having approximately the same height and width as said box and pivotally connected to the free end of said seat to swing from a storage position to a use position, said leg lying along the outer side of said seat and closing the outer side of said box when said seat and said leg are in their storage positions and projecting downwardly from the outer end of said seat supporting the latter when said seat and said legs are in said use positions, first and second braces, a first pivot pivotally connecting one end of said first brace to the underside of said seat, said first brace extending downwardly and outwardly from said first pivot when said seat is in its use position, a second pivot pivotally connecting one end of said second brace to the inner side of said leg, said second brace extending upwardly and inwardly from said second pivot when said leg is in its use position, a third pivot pivotally interconnecting the lower end of said first brace with the upper end of said second brace, the lower end of said first brace abutting the upper end of said second brace when said seat and said leg are in their use positions and preventing said leg from swinging inwardly relative to said seat, a contractile spring having one end connected to said first brace and having an opposite end connected to said leg, said spring urging said leg inwardly relative to said seat when said seat and leg are in their use positions and wrapping partially around said third pivot and urging said leg inwardly when said leg is in its storage position, horizontally spaced feet on the lower end of said leg, said feet frictionally engaging the lower side of said box when said leg is in its storage position and serving to hold said leg releasably in said box, the space between said feet defining a hand hole enabling the lower end of said leg to be grabbed for the purpose of moving said leg between its storage and use positions, a boss projecting upwardly from the lower side of said box, and a resiliently flexible lip on the inner end of said seat and engaging said boss when said seat is in said storage position so as to hold said seat in such position.

* * * * *